United States Patent [19]

Scheurer et al.

[11] Patent Number: 5,001,976

[45] Date of Patent: Mar. 26, 1991

[54] APPARATUS FOR DRAWING IN A LAP SHEET INTO A LAP WINDER

[75] Inventors: Paul Scheurer, Winterthur; Peter Bachinger, Weinfelden, both of Switzerland

[73] Assignee: Rieter Machine Works, Ltd., Winterthur, Switzerland

[21] Appl. No.: 360,329

[22] Filed: Jun. 2, 1989

[30] Foreign Application Priority Data

Jun. 6, 1988 [CH] Switzerland ..... 02149/88

[51] Int. Cl.[5] ..... B30B 15/30; B30B 3/04

[52] U.S. Cl. ..... 100/045; 100/102; 100/166; 100/173; 226/91; 242/55.1; 242/76

[58] Field of Search ..... 100/35, 41, 43, 45, 100/173, 144, 155 R, 161, 162 R, 166, 167, 299, 102; 226/91, 92; 68/265; 242/76, 55.1

[56] References Cited

U.S. PATENT DOCUMENTS

| | | | |
|---|---|---|---|
| 2,776,605 | 1/1957 | McAfoos | 242/76 X |
| 3,462,054 | 8/1969 | Foor | 226/91 |
| 4,110,774 | 8/1978 | Krehbiel et al. | 226/91 X |
| 4,693,405 | 9/1987 | Masse | 226/91 |

FOREIGN PATENT DOCUMENTS

| | | | |
|---|---|---|---|
| 0141258 | 1/1988 | European Pat. Off. . | |
| 368252 | 11/1906 | France | 242/55.1 |
| 1038111 | 9/1953 | France . | |
| 0289337 | 3/1953 | Switzerland . | |
| 912485 | 12/1962 | United Kingdom | 226/91 |

*Primary Examiner*—Harvey C. Hornsby
*Assistant Examiner*—Stephen F. Gerrity
*Attorney, Agent, or Firm*—Kenyon & Kenyon

[57] ABSTRACT

The auxiliary device for drawing in a lap sheet between the calender rollers includes a curved plate and a flexible flat structure secured to a rear edge of the plate. The plate is introduced into a gap between the first two calender rollers and moved about the second roller until entering the gap between the second and third rollers. The start of a lap sheet is then placed on the flexible flat structure and secured thereon and the plate and flexible flat structure then advanced until the lap issues upwardly through the gap between the second and third rollers. The auxiliary device is then removed and the leading edge of the lap sheet introduced between the third and fourth calender rollers for delivery to a winding roller.

13 Claims, 3 Drawing Sheets

APPARATUS FOR DRAWING IN A LAP SHEET INTO A LAP WINDER

This invention relates to a method of drawing in a lap sheet between the calender rollers of a lap winder and to an auxiliary device therefor.

As is known, the textile fibers which are to be combed in a comb of a textile machine are usually supplied to the comb in the form of a lap coil. To this end, a plurality of drafted slivers are formed into a lap sheet and then wound on a lap winder into a coil which can then be delivered to the comb. Generally, before winding-on, the lap is calendered in order to smooth the surfaces of the lap sheet so that the lap sheet can be readily unwound from the coil subsequently on the comb.

Known lap winders usually have two rotatable winding rollers which support a lap coil during winding on as well as a roller calender disposed adjacent one of the winding rollers. In one arrangement which has proved particularly satisfactory, the calender has been composed of four calender rollers disposed in a row substantially coaxial of one of the winding rollers. During operation, the calender rollers are pressed together under a predetermined force in order to effect calendering of the lap sheet. When the start of a new lap sheet is to be drawn into the calender rollers, the force on the calenders is released so that small gaps arise between the calender rollers.

However, the drawing in of the start of a new lap sheet is difficult in cases where the calender arrangement has three or more calender rollers. This is because a lap sheet must be guided around the underside of one of the calender rollers which underside is near the winding roller and then outwards through a gap between this roller and the next calender roller. As the undersides of the calender rollers near the winding roller are inaccessible and, as a rule, cannot even be inspected, the drawing-in operation is difficult to effect.

Thus, while it is relatively simple to feed the start of a new lap sheet downwardly between the first two rollers of a row of calender rollers while the rollers rotate slowly without auxiliary means, it is very difficult to ensure that the start of the lap sheet engages upwardly between the second and third rollers. Of course, a guide plate may be disposed below the calender roller around whose underside the lap sheet has to be guided. The function of such a guide plate would be to guide the start of the lap sheet around the underside of the calender roller into the gap between this roller and the next calender roller while the rollers are rotated slowly. However, such a guide plate arrangement is not reliable in operation and, particularly, if the guide plate is dirty, jamming may readily occur between the guide plate and the calender roll.

Accordingly, it is an object of the invention to enable a new lap sheet to be readily introduced between the calender rollers of a calender having at least three calender rollers.

It is another object of the invention to be able to readily and reliably guide a lap sheet around an inaccessible underside of a calender roller and through a gap between the calender roller and the next calender roller of a lap winder.

It is another object of the invention to provide a relatively simple device to effect a reliable and disturbance free drawing in of a lap sheet into the rollers of a calender arrangement for a lap winder.

Briefly, the invention provides a method of drawing in a lap sheet between the calender rollers of a lap winder as well as an auxiliary device therefore.

The method includes the step of introducing a front edge of a curved plate of the auxiliary device into a first gap between two adjacent calender rollers and of thereafter moving the plate between the two rollers around one of the rollers into a second gap between this roller and a third calender roller. In addition, with one end of a lap sheet attached to a flexible flat structure extending from a trailing end of the plate, the plate is then advanced through the gap between the second and third calender rollers and about the second roller until the flat structure passes through the gap.

After advancing the flat structure through the gap between the second and third calender rollers with the lap sheet thereon, the plate and flat structure are removed from the forward end of the lap sheet is removed from the flat structure. Thereafter, the forward end of the lap sheet is directed into a gap between the third and a fourth calender roller for delivery to a winding roller of the lap winder.

In order to move the plate between the rollers, the calender rollers are pressed together and driven so as to advance the plate through the gaps between the respective rollers.

The auxiliary device is comprised of a plate having at least a curved front part for passing into a gap between two calender rollers and about one of the rollers as well as a flexible flat structure secured to a trailing end of a plate to receive a lap sheet thereon. The plate may be made of any resilient material such as plastic while the flat structure is made of foil and/or cloth, for example, a cloth having a surface containing projecting bristles, hooks, fibers or the like.

The front part of the plate is disposed on a circular radius, for example so as to extend over an angle of from 190° to 230°. In addition, the plate has a plane (i.e. flat) rear part upstream of the trailing end. This rear part extends over a length of from 20% to 70% of the radius of the front part.

In use, the front part of the plate is introduced into the gap between two adjacent calender rollers and is moved about one of the rollers until engaging in a gap between this roller and a third calender roller. With the lap sheet secured to the flexible flat structure, the plate and flat structure are further advanced until the flat structure has passed through the second gap. Thereafter, the lap sheet can be removed and passed into the gap between the third and fourth calender rollers for delivery to the winding roller.

These and other objects and advantages of the invention will become more apparent from the following detailed description taken in conjunction with the accompanying drawings wherein:

FIG. 1 diagrammatically illustrates a vertical sectional view through the parts of a lap winder;

Figure 1:
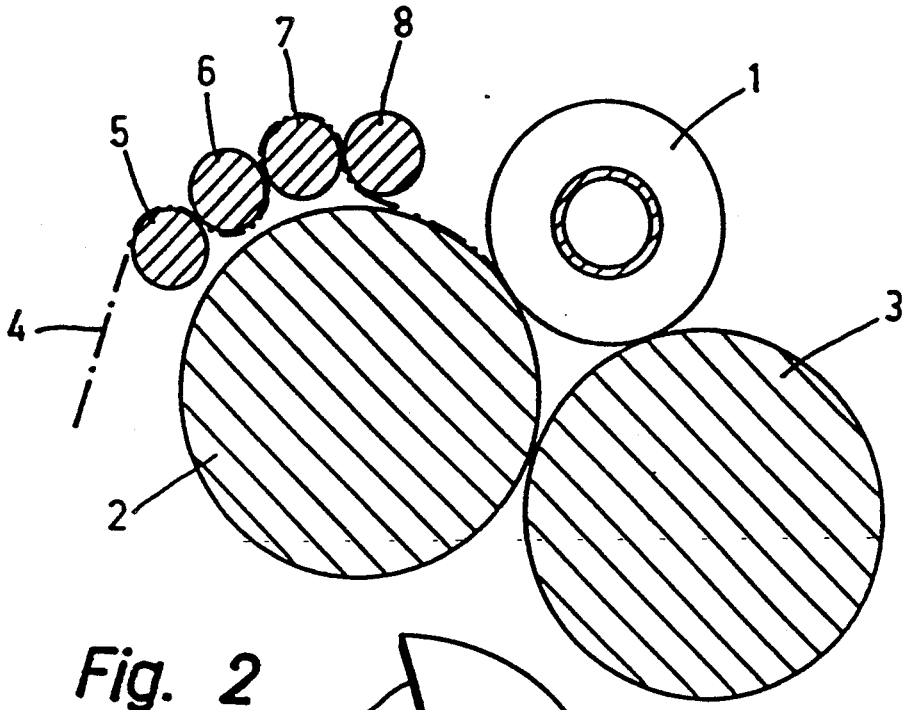

Referring to FIG. 1, the winder is constructed in conventional fashion so as to form a lap coil 1. As indicated, the winder includes a pair of rotatable winding rollers 2, 3 for supporting a lap coil 1 thereon. A lap sheet 4 indicated by a chain-dotted line is passed to a roller calender before reaching the coil 1 and being wound thereon. As indicated, the calender is comprised of four calender rollers 5, 6, 7, 8 which are disposed adjacent the winding roller 2 in a row substantially coaxial thereof. During operation, the calender rollers 5–8 are pressed together with a predetermined force by suitable means (not shown).

Figure 2:
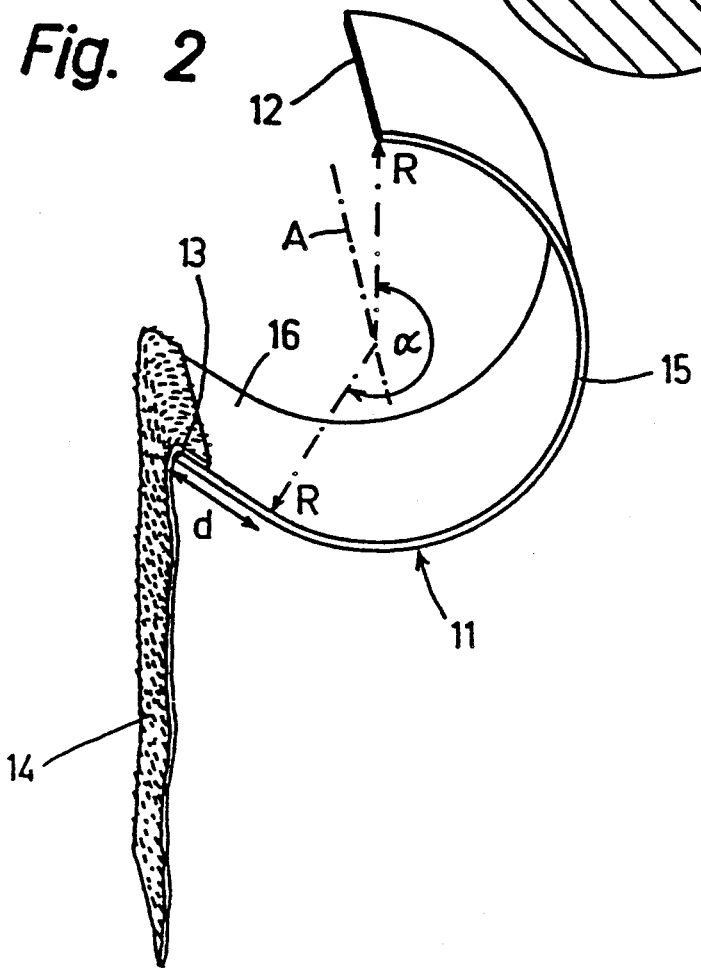
FIG. 2 illustrates a perspective view of an auxiliary device used to draw in a lap sheet between the calender rollers of the lap winder of FIG. 1 in accordance with the invention.

Referring to FIG. 2, the auxiliary device comprises a resilient plate 11 having a front edge 12 and a rear edge 13 as well as a flexible flat structure 14 which is made of foil and/or cloth and which is secured to the rear or trailing edge 13 of the plate 11.

The plate 11 has a front part 15 which curves shell-fashion on a circular radius R around an axis A and a rear part 16 which is less curved than the front part 15 or is preferably substantially plane. The radius R of curvature of the front part 15 is substantially the same as or slightly greater than the radius of the calender rollers, more particularly of the roller 6. The front part 15 extends, as seen from the axis A, over an angle (measured in a plane perpendicular to the axis A) of more than 180°, for example 190° to 230°, preferably approximately 210°. The length d of the plane rear part 16 is approximately from 20 to 70% of the radius R. However, the rear part 16 could be omitted—i.e., be of zero length. The plate 11 can, conveniently, be made of plastics, for example, polyvinylchloride of a thickness of from approximately 1 to 2.5 millimeters (mm).

The flexible flat structure 14 is made of a foil, for example, plastics foil, and/or cloth. The structure 14 is, for example, a woven fabric which is coated on the underside with a plastics foil and which has the top surface projecting inclined fine bristles or fibres or hooks which are directed towards the rear edge 13 of the plate 11. Flat structures of this kind are known as textile brush clothing.

Figure 3:
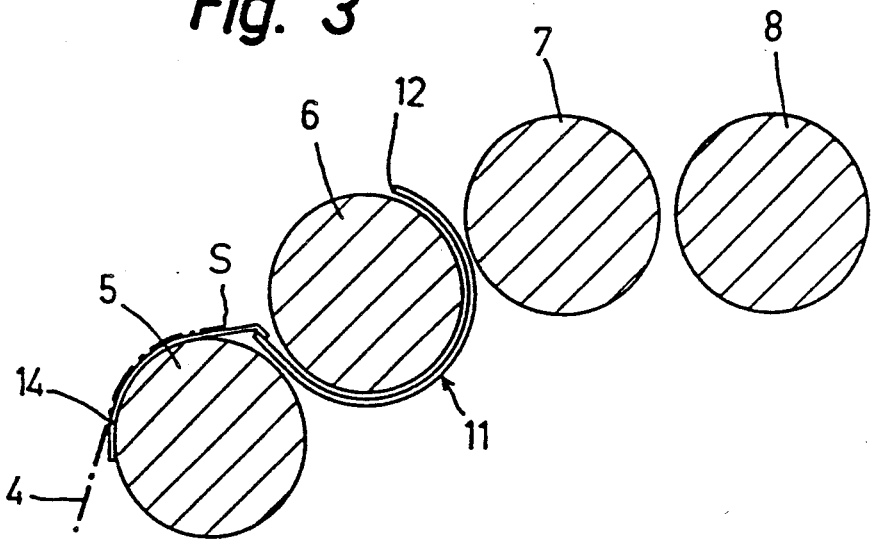
FIG. 3 illustrates a position of the auxiliary device during movement about a second calender roller.

The use of the auxiliary device to draw-in the start S of a new lap sheet 4 between the calender rollers 5–8 will be described hereinafter with reference to FIGS. 3 to 5.

First, the pressure on the calender roller 5–8 is removed so that the rollers move apart to form small gaps, of a width, for example, of approximately three millimeters between any two rollers 5–8. The plate 11 with the front edge 12 at the front is then introduced downwards manually into the gap between the rollers 5 and 6 and moved around the roller 6 until the front edge 12 re-emerges upwardly through the gap between the rollers 6 and 7, as shown in FIG. 3. The plate 11, although resilient, is always sufficiently rigid to ensure that the front edge 12 of the plate 11 introduced between the rollers 5 and 6 always reaches the gap between the rollers 6 and 7. Thereafter, and as shown in FIG. 3, the flat structure 14 secured to the rear edge of the plate 11 is placed above the roller 5 and an initial part of the new lap 4 is placed on the flat structure 14.

Figure 4:
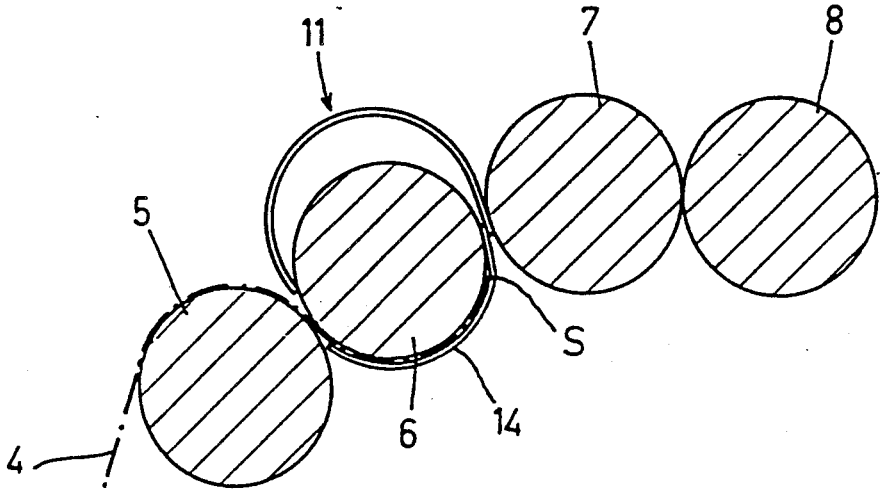
FIG. 4 illustrates a view similar to FIG. 3 of the auxiliary device in a position prior to passage from between the second and third rollers of the calender rollers.

Referring to FIG. 4, the calender rollers 5–8 are then pressed together and slowly rotated. The plate 11 is therefore drawn upwards in the nip between the rollers 6 and 7 until reaching the position shown in FIG. 4. The effect of the plane rear part 16 (FIG. 2) of the plate 11 is that the front part of the pate 11 disengages from the roller 6 and does not re-enter the nip between the roller 6 and the roller 5. In the position shown in FIG. 4, the flat structure 14 secured to the rear edge of the plate 11, and the initial part of the lap sheet 14 sticking to the structure 14, extend around the underside of the roller 6.

Figure 5:
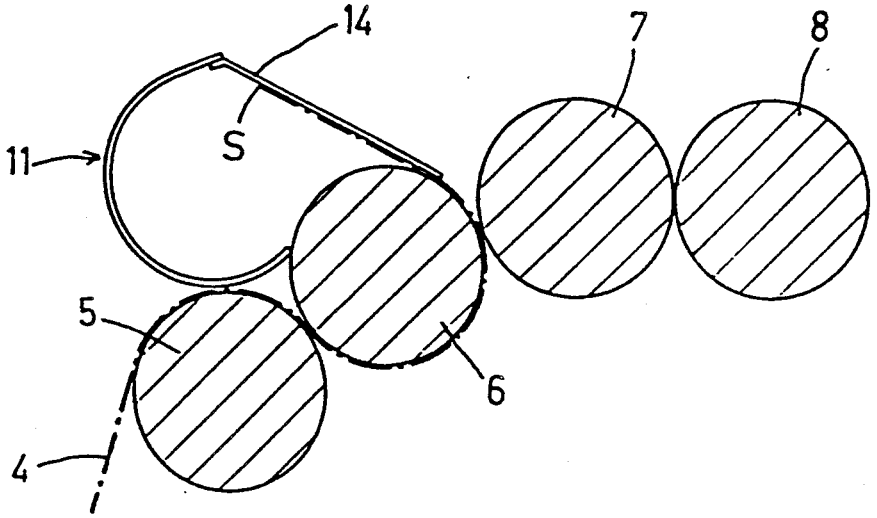
FIG. 5 illustrates a view similar to FIGS. 3 and 4 with the auxiliary device completely passed through the gap between the second and third rollers.

The rollers 5–8 then rotate further until the plate 11 has fully emerged upwardly from the nip between the rollers 6 and 7 and the structure 14, together with the start of the new lap sheet 4, has left the latter nip, as shown in FIG. 5. It is immaterial if the start of the lap sheet 4 disengages from the structure 14 and drops on the roller.

The auxiliary device is then removed and the start of the lap sheet 4 is placed over the roller 7 and introduced between the rollers 7 and 8. The calender rollers 5–8 are no longer pressed together. Hence, a small gap is again present between the rollers 7 and 8. The lap sheet 4 which issues downwardly from the gap between the rollers 7 and 8 then runs onto the periphery of the winding roller 2 of FIG. 1 and is driven thereby to the coil 1.

The invention thus provides a relatively simple auxiliary device and method for drawing in of a fresh lap sheet between the calender rollers of a lap winder. Further, the auxiliary device ensures that the lap sheet is guided about the underside of a calender roller which is otherwise inaccessible and blocked by a winding roller.

What is claimed is:

1. An auxiliary device for drawing in a lap sheet between calender rollers of a lap winder, said device comprising an arcuate plate having at least a front part curved about an axis transverse to said plate for passing longitudinally into a gap between two calender rollers about one of the rollers; and a flexible flat structure secured to a trailing end of said plate to receive a lap sheet thereon, said flat structure being made of at least one of foil and cloth.

2. A device as set forth in claim 1 wherein said plate has a plane rear part upstream of said trailing end.

3. A device as set forth in claim 2 wherein said front part of said plate is disposed on a circular radius and said rear part extends from said front part over a length of from 20% to 70% of said radius.

4. A device as set forth in claim 3 wherein said front part extends over an angle of from 190° to 230°.

5. A device as set forth in claim 4 wherein said front part extends over an angle of 210°.

6. A device as set forth in claim 1 wherein said plate is made of plastic.

7. A device as set forth in claim 6 wherein said plate is made of polyvinylchloride and is of a thickness of from 1 to 2.5 millimeters.

8. A device as set forth in claim 1 wherein said flat structure has a surface containing projecting bristles for securing a lap sheet thereon.

9. An auxiliary device for drawing in a lap sheet between calender rollers of a lap winder, said device comprising a resilient arcuate plate having a front part curved about an axis transverse to said plate for passing circumferentially about a calender roller; and a flexible flat structure secured to a trailing end of said plate to receive a lap sheet thereon.

10. A device as set forth in claim 9 wherein said plate has a plane rear part upstream of said trailing end and said front part of said plate is disposed on a circular radius.

11. A device as set forth in claim 10 wherein said rear part extends from said front part over a length of from 20% to 70% of said radius.

12. A device as set forth in clam 10 wherein said plate is made of polyvinylchloride and is of a thickness of from 1 to 2.5 millimeters.

13. A device as set forth in claim 9 wherein said flat structure has a surface containing projecting bristles for securing a lap sheet thereon.

* * * * *

UNITED STATES PATENT AND TRADEMARK OFFICE

CERTIFICATE OF CORRECTION

PATENT NO. : 5,001,976

DATED : March 26, 1991

INVENTOR(S) : PAUL SCHEURER, et al

It is certified that error appears in the above-identified patent and that said Letters Patent is hereby corrected as shown below:

Column 1, line 16 change "subsequently on" to -and forwarded to-
Column 2, line 5 change "therefore." to -therefor.-
Column 2, line 20 change "from" to -and-
Column 4, line 4 change "pate" to -plate-

Signed and Sealed this

Eighth Day of September, 1992

*Attest:*

DOUGLAS B. COMER

*Attesting Officer*

*Acting Commissioner of Patents and Trademarks*